US007120263B2

(12) United States Patent
Azima et al.

(10) Patent No.: US 7,120,263 B2
(45) Date of Patent: Oct. 10, 2006

(54) BENDING WAVE ACOUSTIC RADIATOR

(75) Inventors: Henry Azima, Cambridge (GB); Martin Colloms, London (GB); Graham Bank, Suffolk (GB); Charles Bream, Cambridgeshire (GB); Julian Fordham, Cambridgeshire (GB)

(73) Assignee: New Transducers Limited, London (GB)

( * ) Notice: Subject to any disclaimer, the term of this patent is extended or adjusted under 35 U.S.C. 154(b) by 488 days.

(21) Appl. No.: 10/102,009

(22) Filed: Mar. 21, 2002

(65) Prior Publication Data

US 2002/0141607 A1 Oct. 3, 2002

Related U.S. Application Data

(60) Provisional application No. 60/350,031, filed on Jan. 23, 2002, provisional application No. 60/277,967, filed on Mar. 23, 2001.

(30) Foreign Application Priority Data

Mar. 23, 2001 (GB) ..... 0107314.7
Dec. 20, 2001 (GB) ..... 0130469.0

(51) Int. Cl.
*H04R 25/00* (2006.01)

(52) U.S. Cl. ..... 381/152; 381/423; 381/425; 381/426; 381/429; 381/424

(58) Field of Classification Search ..... 381/152, 381/337, 396, 423, 425, 431, 190, 424, 429, 381/426, 164; 181/157, 166, 163, 164, 165, 181/152, 337, 396, 423, 425, 431, 190, 167
See application file for complete search history.

(56) References Cited

U.S. PATENT DOCUMENTS

| | | | | |
|---|---|---|---|---|
| 1,500,331 | A | 7/1924 | Marriott | |
| 5,025,474 | A * | 6/1991 | Tanaka et al. | 381/333 |
| 5,231,672 | A * | 7/1993 | Tsao | 381/425 |
| 6,332,029 | B1 | 12/2001 | Azima et al. | |

FOREIGN PATENT DOCUMENTS

| | | |
|---|---|---|
| GB | 2 336 566 A | 10/1999 |
| WO | WO 98/39947 A1 | 9/1998 |
| WO | WO 00/15000 A1 | 3/2000 |
| WO | WO 00/22877 A1 | 4/2000 |
| WO | WO 00/65869 A2 | 11/2000 |
| WO | WO 00/70909 A2 | 11/2000 |
| WO | WO 00/78090 A2 | 12/2000 |

* cited by examiner

*Primary Examiner*—Curtis Kuntz
*Assistant Examiner*—Tuan D. Nguyen
(74) *Attorney, Agent, or Firm*—Foley & Lardner LLP

(57) ABSTRACT

A bending wave panel-form acoustic radiator formed from sheet material to define an acoustically active area and having at least one integral stiffening member in the form of a corrugation extending out of the plane of the sheet and at least partially across the acoustically active area of the radiator, which stiffening member is of substantially U-shaped cross section. Also disclosed is a method of making a bending wave panel-form acoustic radiator, comprising forming a sheet into a panel having at least one integral corrugation member extending out of the plane of the sheet and at least partly across the sheet and of substantially U-shape cross-section, to stiffen the sheet to have a desired ability to support and propagate bending waves.

31 Claims, 11 Drawing Sheets

BENDING WAVE ACOUSTIC RADIATOR

This application claims the benefit of U.S. provisional application No. 60/277,967, filed Mar. 23, 2001, and U.S. provisional application No. 60/350,031, filed Jan. 23, 2002.

TECHNICAL FIELD

The invention relates to bending wave acoustic radiators, e.g. for use in loudspeakers of the kind described in U.S. Pat. No. 6,332,029 of New Transducers Limited, which is incorporated herein by reference.

BACKGROUND ART

It is known that a flat sheet or board can be reinforced, e.g. by corrugating the sheet, or by moulding or pressing a pattern into the sheet or board. See GB 2,336,566A of S. P. Carrington, which shows that complex corrugations encompassing two or more conceptual axes can increase bending stiffness of the sheet.

At present bending wave panel-form acoustic radiators are normally made from composites comprising a core sandwiched between skin layers, although alternatively such radiators may be monolithic sheet-like structures, e.g. of plastics, metal or card.

In addition, it is known from WO00/15000 of New Transducers Limited to stiffen a panel-form acoustic radiator such that its bending stiffness varies over its area.

It is also known from WO00/65869 of New Transducers Limited to dish the portion of a bending wave panel of a loudspeaker located within the contact ring of the voice coil of a moving coil vibration transducer mounted on the panel to provide local stiffening of the panel to control aperture resonance.

It is an object of the invention to provide a simple and relatively inexpensive bending wave panel-form acoustic radiator.

SUMMARY OF THE INVENTION

From one aspect the invention is a bending wave panel-form acoustic radiator formed from sheet material to define an acoustically active area and comprising at least one integral stiffening member in the form of a corrugation extending out of the plane of the sheet and at least partially across the acoustically active area of the radiator, which stiffening member is of substantially U-shaped cross section.

The sheet may be substantially uniform in thickness over the acoustically active area within the limitations imposed by the integral forming of the stiffening member(s).

The bending wave panel-form acoustic radiator may comprise stiffening members arranged to extend in a plurality of directions across the acoustically active area.

The bending wave panel-form acoustic radiator may comprise stiffening members arranged in a parallel array.

The stiffening members may extend substantially wholly across the acoustically active area.

The acoustically active area may be substantially filled with closely spaced stiffening members.

The stiffening members may be rectilinear.

The stiffening members may be disposed in a substantially radial array extending from a position on the acoustically active area at which a vibration exciter is intended to be located. Substantially planar portions of the acoustically active area of the sheet may be defined between the substantially radial stiffening members.

The stiffening members may be of substantially uniform cross-section over their lengths.

The acoustically active area may be generally rectangular and the stiffening members may extend at an angle to the edges of the acoustically active area.

The stiffening members may be endless or may be discrete.

The stiffening members may comprise portions of their length extending in different directions.

The stiffening members may be shaped to be rounded in cross-section so as to avoid sharp edges.

The sheet material may be of a plastically deformable material.

The sheet may comprise a termination area at least partially surrounding the acoustically active area.

The acoustic radiator may consist of the sheet. The bending wave panel-form acoustic radiator may consist of a plurality of the corrugated sheets. The plurality of sheets may be united face to face. The corrugations on one sheet may be angled with respect to adjacent corrugations on an adjacent sheet.

The or each stiffening member may be of substantially uniform height over its length.

From another aspect the invention is a loudspeaker comprising a bending wave panel-form acoustic radiator and a vibration transducer coupled to the acoustically active area of the panel.

The panel may be a plastics thermoforming. The vibration transducer may be mounted to the side of the panel from which plastics was moved to form the stiffening member.

From yet another aspect the invention is a method of making a bending wave panel-form acoustic radiator, comprising forming a sheet into a panel having at least one integral corrugation member extending out of the plane of the sheet and at least partly across the sheet and of substantially U-shaped cross-section, to stiffen the sheet to have a desired ability to support and propagate bending waves.

The method may comprise arranging the at least one stiffening member to stiffen the sheet to support a desired frequency distribution of standing waves in the panel.

The method may comprise forming the sheet to have one or more marginal or other portions for connecting or supporting the acoustic radiator on framing or other support means.

The method may comprise forming the marginal or other connection portions to provide a resilient suspension.

The method may comprise forming the marginal or other portions to provide means by which the acoustically active area of the sheet can be substantially restrained.

The method may comprise choosing an arrangement of the stiffening members to reduce or to define the mean free path of a line of bending weakness in the acoustically active area of the sheet. The degree to which this is done will depend on the required properties of the resulting panel and aspects such as the required frequency range.

The method may comprise uniting a superposed pair of the corrugated sheets. The superposed sheets may be united by welding. The welding may comprise coating the faces of the sheets to be welded together with a thermoplastic material having a lower melting point than the material of the sheets, bringing the sheets into face to face contact and heating the sheets to melt the coating to fuse the sheets together.

The method may comprise arranging the corrugations on one of the pair of sheets to be angled with respect to the corrugation on the other of the pair of sheets.

The method may comprise making an acoustic radiator consisting of the sheet or a plurality, i.e. two or more, of the sheets.

Thus sheet material, by thermoforming or any other suitable process, may be transformed into a bending wave panel acoustic radiator with a useful mass to stiffness ratio. Such a panel may support bending wave resonances and may be used for acoustic devices of the distributed mode variety, including loudspeakers.

The forming may include planar edge sections, pads or strips for convenient mounting to a ground structure, e.g. framing, for example via resilient stubs, or for adhesive connection to the ground structure. Following distributed mode teaching for a useful distribution of bending wave resonant modes in an acoustic panel, the bending stiffness which results from a given formation of stiffening members may have multiple directional properties. These may be adjusted in terms of relative alignment and magnitude to arrive at a chosen modal frequency distribution.

Computer analysis may be made in macro elements to examine the overall panel behaviour, for example in the context of matching to panel aspect ratio, while micro modelling can examine sub-sections of the stiffening member pattern to explore local stiffness and the relationship of a suitable drive point and vibration transducer to the panel.

For a given panel size, a given stiffening member pattern may be scaled or dimensioned to alter the properties of the panel. For example, the general image of the pattern may be zoomed, or alternatively reduced in respect of its application to the formable or mouldable sheet. In a related context the stiffening member may be based on fractal geometry likely with a finite truncation of the otherwise infinitely recurring sequences.

Different fractal algorithms will provide a useful design variation in mean path length and directional stiffness. In addition, combinations of stiffening member pattern may be distributed over the panel area to provide areal or localised bending stiffness. This valuable property may be used to balance or equalise the frequency range and frequency response, to change the relationship of acoustic power with frequency for different areas which may alter the directivity in selected axes. It may also be used to blend or smooth acoustic artefacts resulting at critical frequencies, where the wave speed in the panel is a unit or multiple of the speed of sound in air.

From one viewpoint, the stiffening member pattern may be viewed as a more discrete series of springs and masses than represented by the continuum of known bending wave panels. In design the discrete nature of the bending panel makeup makes it amenable to micro design of the complex panel behaviour in bending providing the designer with the freedom to fine-tune the performance in any areas or combination of properties required. In one sense the bending wave panel is being synthesised from definable designated elements of sufficient density to be approximately equivalent to a uniform panel construction.

The panel may be itself subject to simple or complex curvature, and may comprise the integer of acoustic loading.

Whether the material is transparent or not the stiffening member pattern may also be used decoratively, e.g. as a texture, or to provide chosen translucency. Even in the translucent state the overall light transmissivity can be high. Thus the panel of the present invention may be suitable as the light diffuser of a combination light and sound system where the acoustic panel is also the diffuser. The acoustically directed stiffening member pattern may be combined with fresnel lens equivalent patterning to additionally give directed illumination in conjunction with the sound panel operation.

Within the restrictments imposed by generally U-shaped cross-section, the side walls of the stiffening member corrugations may be near vertical or sloped or given a desired shape, e.g. a sine curve, to alter the stress/strain relationships between the flat areas or lands and the wall sections. Variations in depth and sidewall profile are possible over the area of the panel and/or over the length of the stiffening members.

Stiffening member patterns may range from spirals, concentric rings, diagonally offset groups or arrays of rings or rectangular subsets of rings, or parallel straight lines. Regular patterning to one side of the mean plane of the sheet may be alternated with offset patterning to the other side of the mean plane of the sheet, to break the axis of symmetry in respect of the transverse bending axis of the panel. A wide variety of mathematical repeating functions are applicable including fractal forms for the stiffening members.

Due to the versatility of the design process, useful distributed mode operation, e.g. approximating to near optimal distributed mode teaching, may be generated with unusual and unexpected shapes, e.g. of natural forms, fish, birds or animals, or artistic forms for decorative speakers.

BRIEF DESCRIPTION OF THE DRAWING

Examples that include the best mode for carrying out the invention are described in detail below, purely by way of example, with reference to the accompanying drawing figures, in which.

Figure 1:
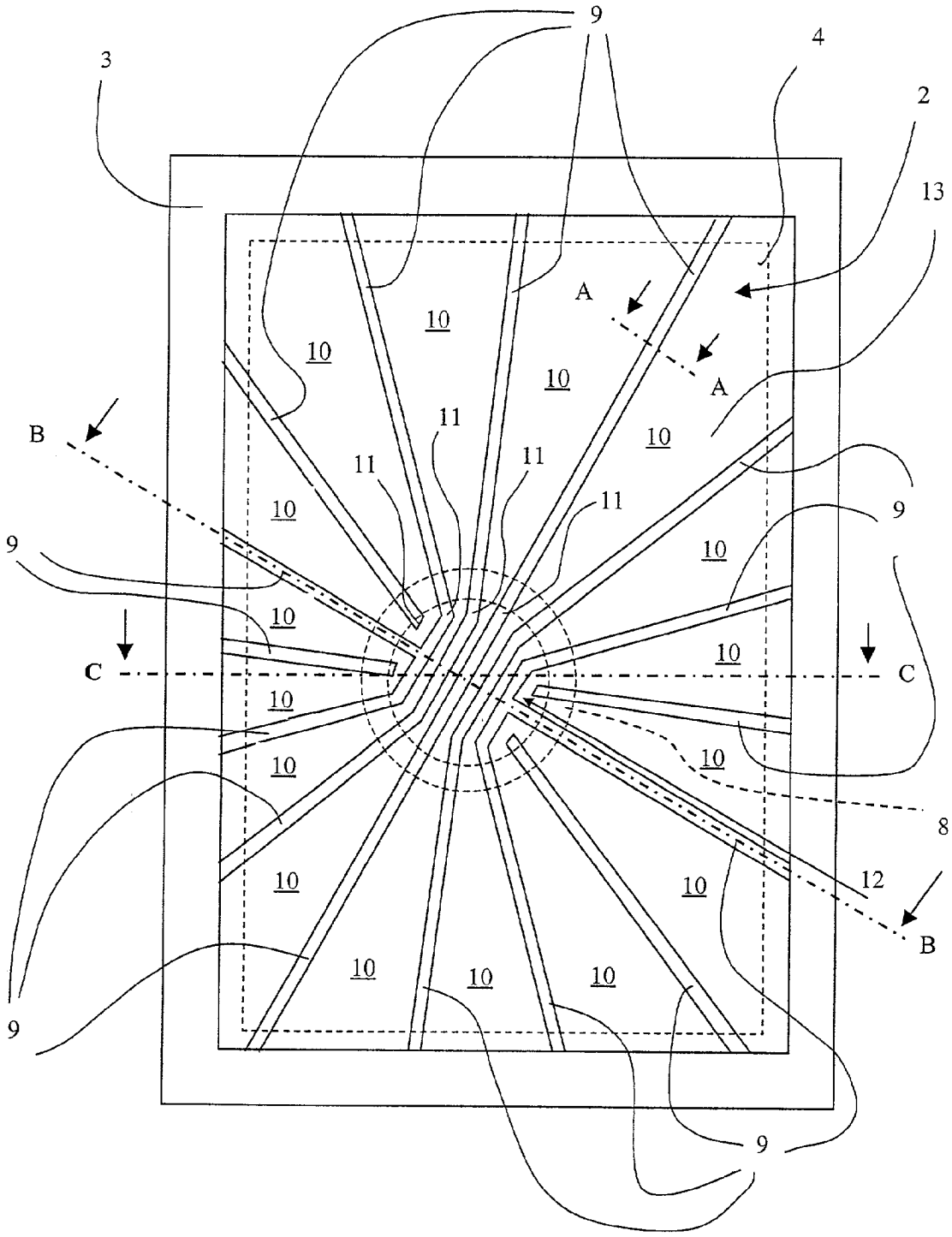
FIG. 1 is a plan view of a panel-form bending wave loudspeaker according to the invention.
Figure 2:
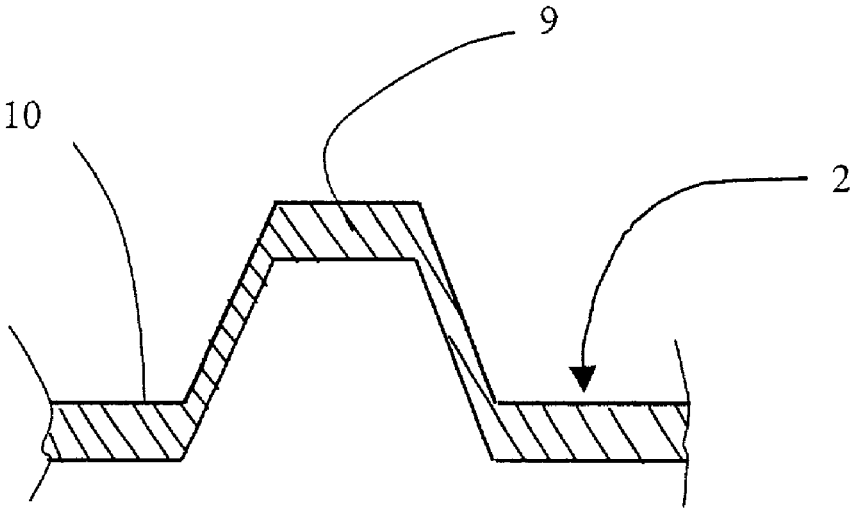
FIG. 2 is a partial cross-section on the line A—A of FIG. 1.
Figure 3:
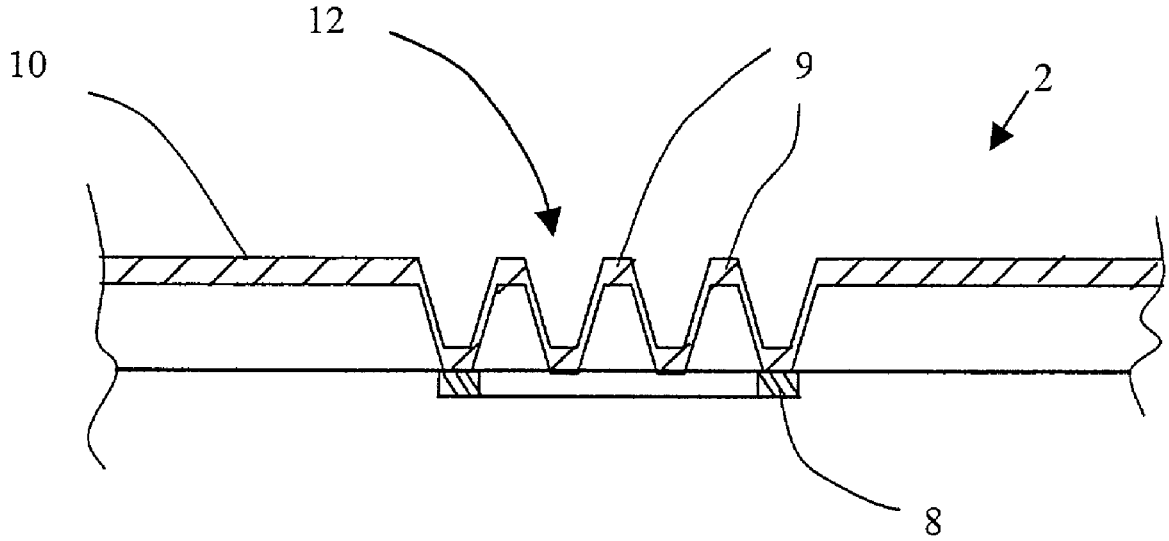
FIG. 3 is a cross-section on the line B—B of FIG. 1.

It is to be understood that the invention is not limited in its application to the details of construction or the arrangement of components of preferred embodiments described below and illustrated in the drawing figures.

BEST MODES FOR CARRYING OUT THE INVENTION

Figure 4:
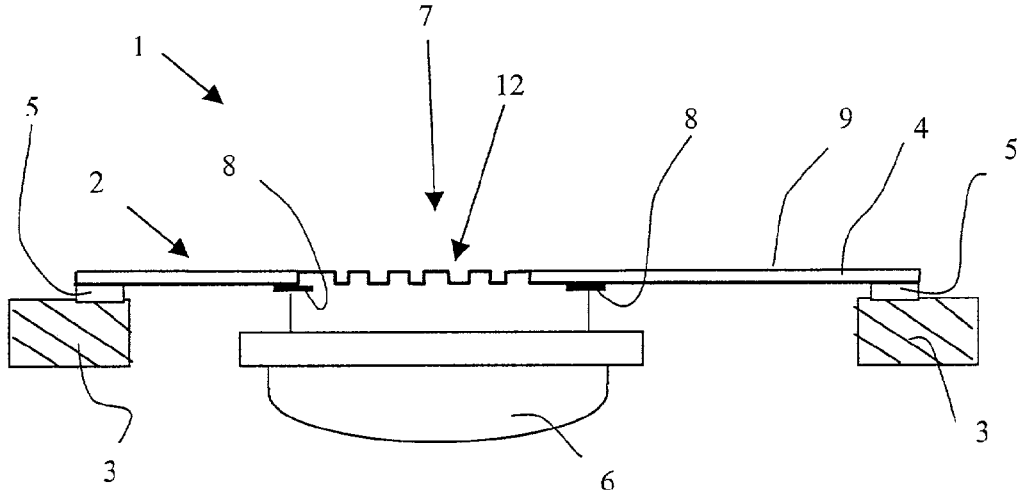
FIG. 4 is a cross-section on the line C—C of FIG. 1.

In FIGS. 1 to 5 of the drawing there is shown a loudspeaker (1) having a rectangular bending wave panel-form acoustic radiator or diaphragm (2) mounted at its periphery (4) in a surrounding rectangular frame (3) of medium density fibreboard (MDF). As shown in FIG. 4, the periphery (4) of the diaphragm is fixed to the frame by double-sided adhesive tape (5) to define an acoustically active area (13) bounded by the fixing (5). An inertial moving coil bending wave exciter (6) is coupled to the diaphragm at a generally central position (7) of the diaphragm via a coupler ring (8), e.g. with the aid of adhesive means. The exciter can thus apply bending wave energy to the diaphragm to cause it to vibrate when an electrical signal is applied to the exciter, e.g. as taught in U.S. Pat. No. 6,332,029, whereby the diaphragm resonates as a distributed mode device.

The diaphragm is thermoformed from flat plastics sheet to have an array of rectilinear corrugations (9) of generally U-shaped cross-section radiating from the generally central exciter position to the periphery (4) of the diaphragm. The depth and profile of each corrugation is constant over its length. As shown there are sixteen of the corrugations arranged at mutual angles of 22.5° from the exciter position. The radial array of corrugations (9) define between them generally flat triangular areas (10) of the diaphragm.

It will be noted that the inner ends (11) of the corrugations (9), that is the portions of the corrugations inside the coupler ring (8), are extended and joined to form a closely spaced parallel array (12) of the corrugations (9), to provide additional stiffening of the portion of the diaphragm inside the coupler ring (8). The coupler ring effectively acts in the manner of a faceskin on the core of a composite panel and locally stiffens the panel in both the X and Y directions. This results in a low stiffness panel exhibiting a high bending stiffness at the drive position, which is useful in achieving good low and high frequency output from a small panel size.

Figure 5:
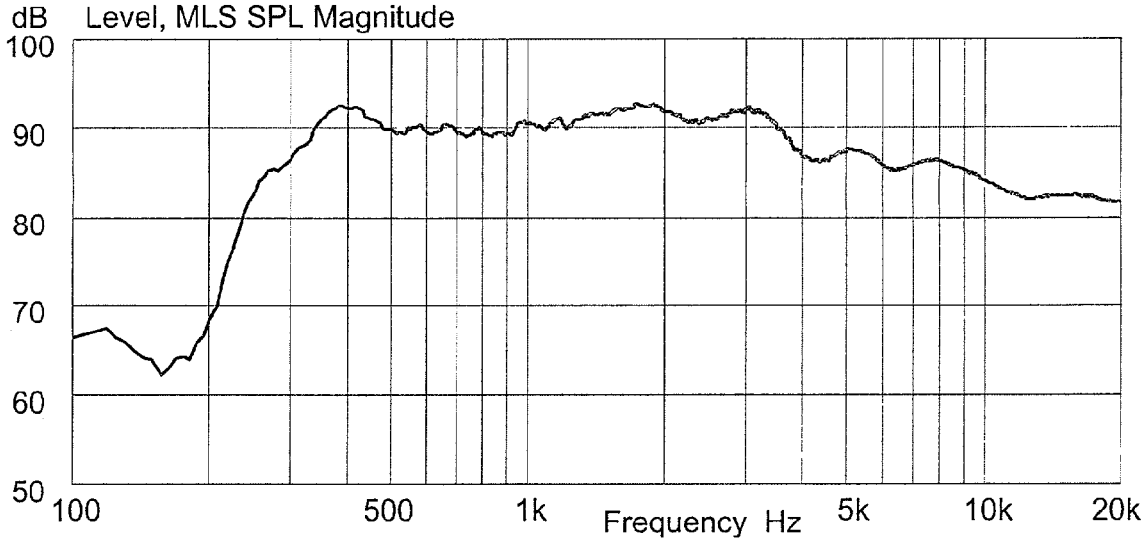
FIG. 5 is a graph of the frequency response of a loudspeaker of the kind shown in FIGS. 1 to 4.

FIG. 5 is a graph of sound pressure level against frequency of a loudspeaker according to FIGS. 1 to 4 with a diaphragm having an active size measuring 120 mm by 80 mm, and a total sheet size of 130 mm by 90 mm. The measurement was taken in free space in an open back, unbaffled condition at 85 dB/Watt at 0.5 m on axis. The diaphragm is a vacuum forming of a sheet of black polypropylene copolymer of 400 μm thickness. The frame has overall dimensions of 150 mm by 110 mm defining an aperture of 120 mm by 80 mm. The panel to frame termination is provided by double-sided pressure sensitive adhesive tape of 5 mm width round the entire frame. The bonding of the exciter to the diaphragm is by means of a cyanoacrylate adhesive, and its position on the diaphragm is at the 4/9th Lx, 3/7th Ly position taught in U.S. Pat. No. 6,332,029.

Figure 6:
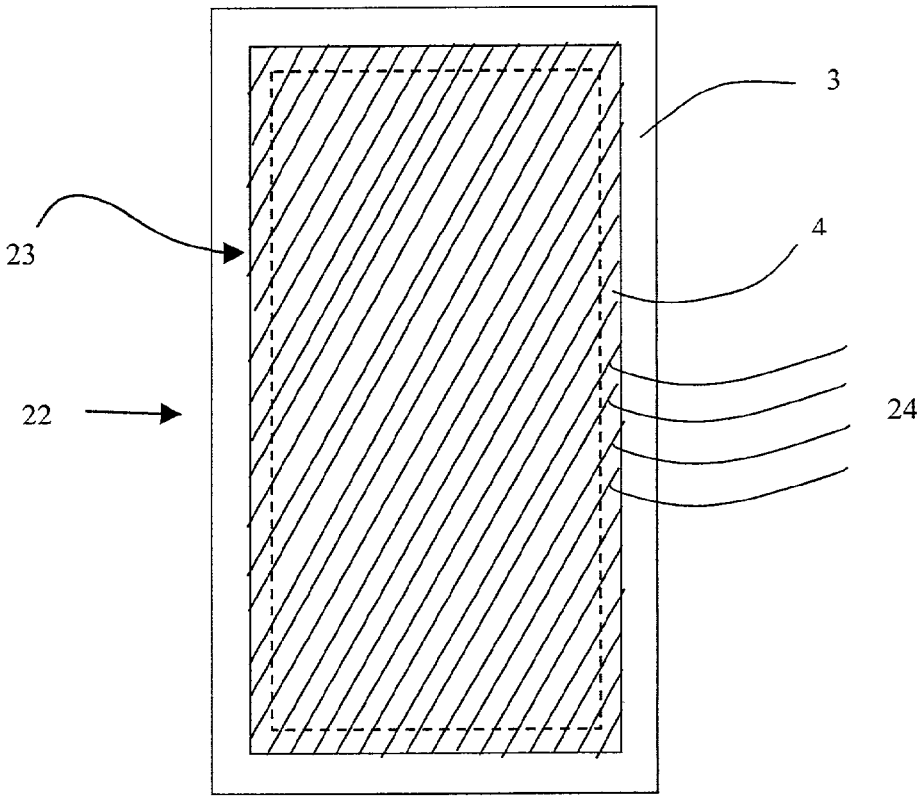
FIG. 6 is a plan view of a further embodiment of acoustic diaphragm according to the invention.

In FIG. 6 there is shown an alternative form of acoustic diaphragm (22) e.g. for a panel-form bending wave loudspeaker of the same general kind as the diaphragm (2) shown in FIGS. 1 to 4. As shown in FIG. 6 the diaphragm (22) is a sheet stiffened with a parallel array (23) of oblique rectilinear corrugations (24) of sinusoidal cross-section, which greatly increase the bending stiffness of the diaphragm in a direction at right angles to the corrugations, surrounded by a margin or peripheral portion (4).

As an example of the embodiment of FIG. 6, a 200 mm×60 mm panel was produced. This was manufactured by vacuum forming a 400 μm thick polypropylene copolymer film. In this case the corrugation pattern was made up of straight corrugations, with a sinusoidal cross-section. These corrugations were orientated at 10°, to the Lx axis of the panel, to achieve a near optimal modal fill for the panel aspect ratio. The diaphragm was produced from a one-part tool using conventional vacuum forming technology.

Figure 7:
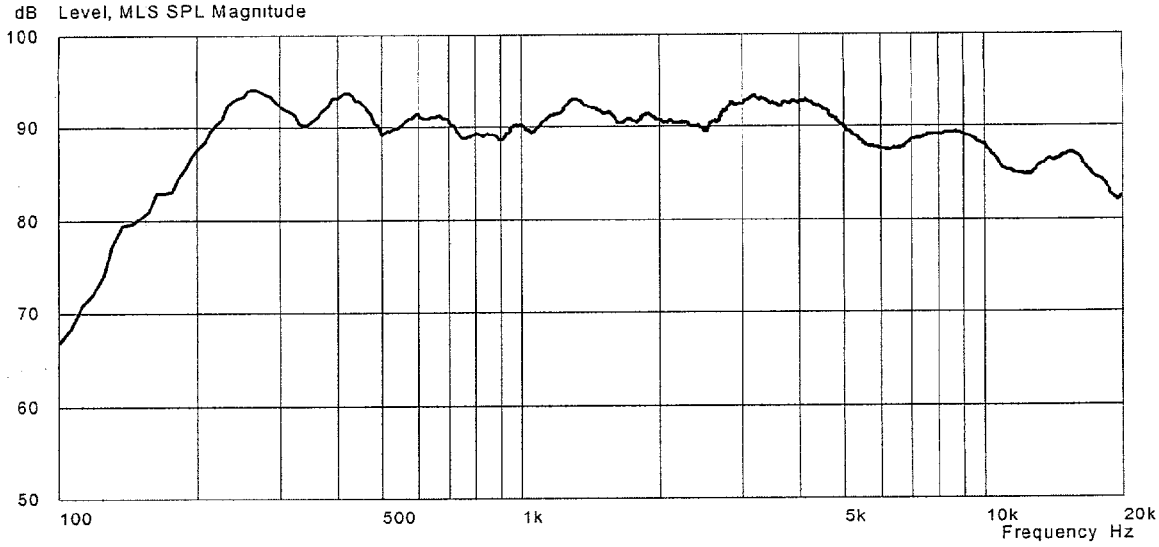
FIG. 7 is a graph of the frequency response of a loudspeaker using the acoustic diaphragm of FIG. 6.

The acoustic performance was determined by adhesively bonding a 4 ohm 25 mm diameter electromagnetic drive motor or exciter (Tianle 0998-04) at a position (89 mm Lx, 85 mm Ly) in accordance with the teaching in U.S. Pat. No. 6,332,029. The panel was mounted to a rigid, open-backed picture frame (245 mm×100 mm) using pressure sensitive adhesive to provide a restrained edge termination and no separate suspension. The acoustic performance of the loudspeaker (measured at 0.5 m, on-axis, with a drive voltage of 2.83v) is shown in FIG. 7. This demonstrates that good low frequency and high frequency extension can be achieved, with good modal fill, with a small panel area. In this case a bandwidth of 180 Hz to 18 kHz has been achieved with a panel area of 120 $cm^2$ (bandwidth specified at −6 dB cut off points). This also demonstrates that good acoustic output can be achieved, with this type of panel, without the need for a separate compliant suspension.

Figure 8:
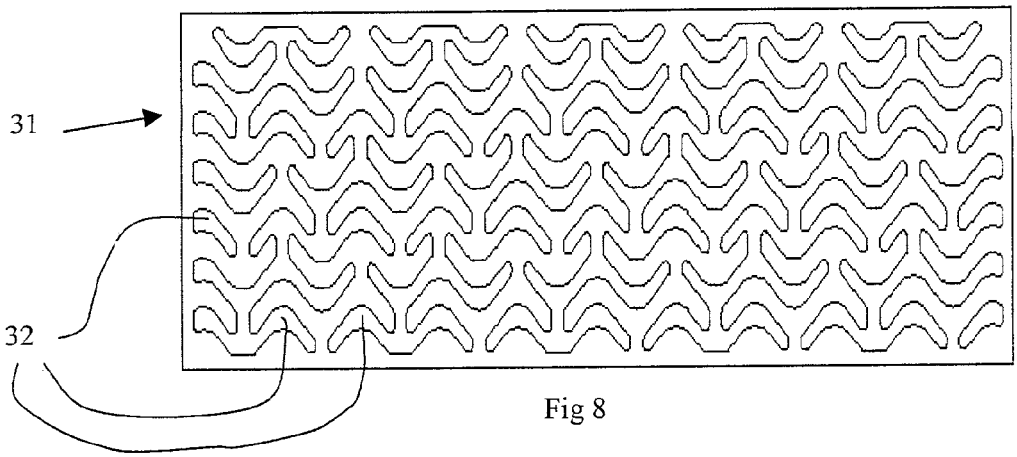
FIGS. 8 to 11 are plan views of further embodiments of acoustic diaphragm according to the invention.
Figure 9:
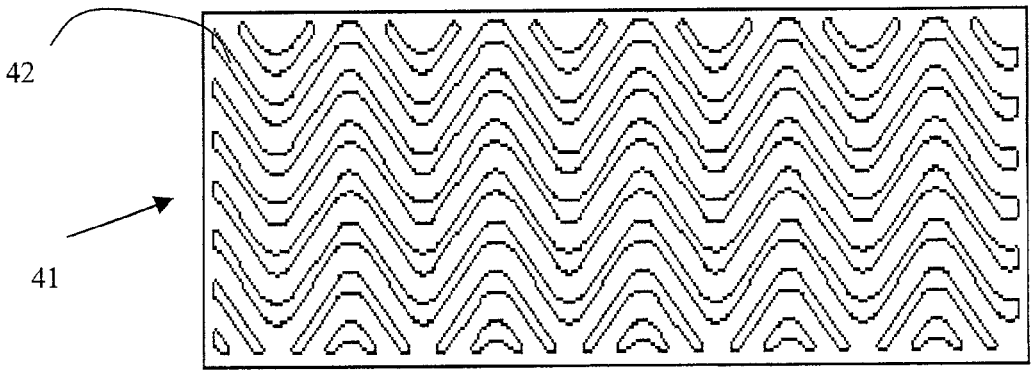
Figure 10:
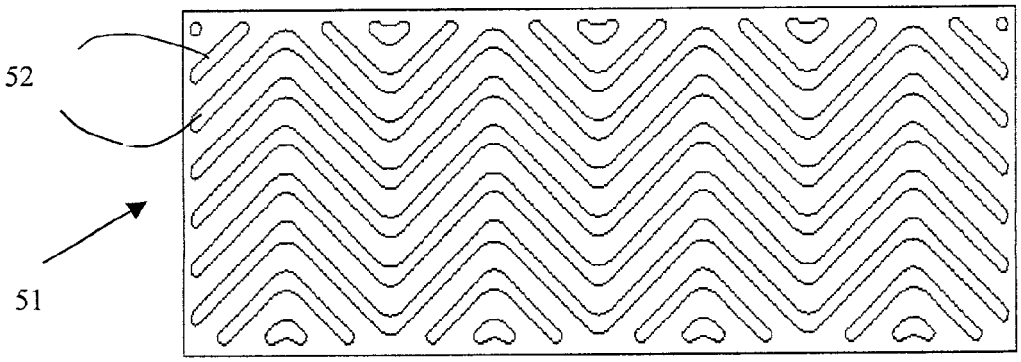
Figure 11:
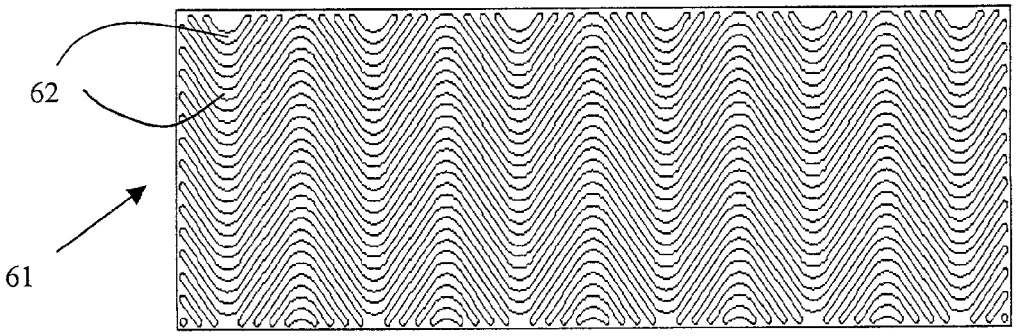

FIGS. 8 to 11 show other possible patterns of corrugations on an acoustic diaphragm made in accordance with the present invention. FIG. 8 shows an acoustic diaphragm or radiator (31) having a pattern of discrete corrugations (32) extending generally obliquely across the radiator each consisting of groups of interconnected parallel sinusoids. FIGS. 9 to 11 show acoustic diaphragms or radiators (41,51,61, respectively) having alternative patterns of corrugations (42,52,62, respectively) consisting of sinusoids extending from one end of the radiator to the other.

Figure 12:
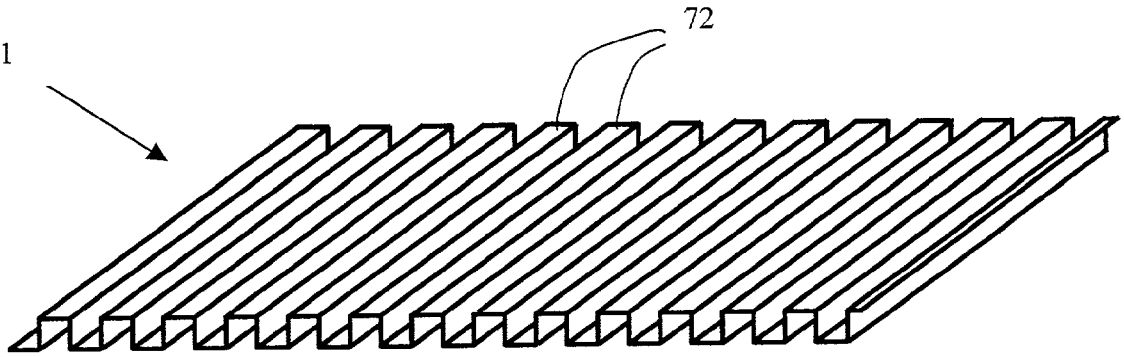
FIG. 12 is a perspective view of a further embodiment of acoustic diaphragm according to the invention.

FIG. 12 is a perspective view of a further embodiment of acoustic diaphragm (71) generally similar to that of FIG. 6, but in which the corrugations (72) are parallel to the short edges of the rectangular sheet and are closely spaced and extend wholly across the sheet from one long edge to the other. The cross-section of the corrugations is generally square.

Figure 13:
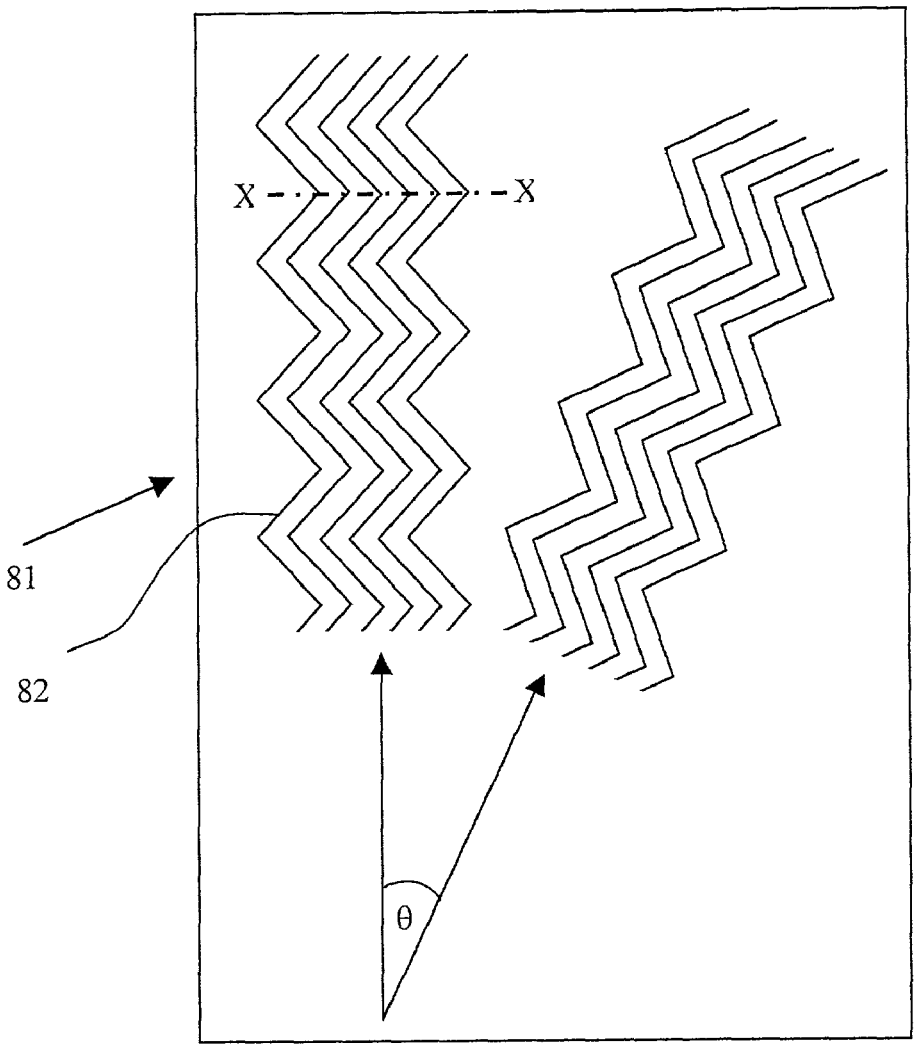
FIG. 13 is a plan view of a yet further embodiment of acoustic diaphragm according to the invention.
Figure 14:
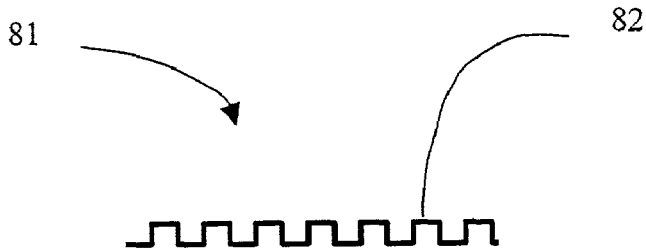
FIG. 14 is a partial cross-section on the line X—X of FIG. 13.

FIG. 13 is a plan view of another possible acoustic diaphragm (81) having a pattern of corrugations (82) which are of zigzag form and of generally square cross-section, as shown in FIG. 14. FIG. 13 shows two possible arrangements of the corrugations on the sheet, namely extending parallel with the long edges of the sheet or at an angle θ to the long edges of the sheet.

Figure 15:
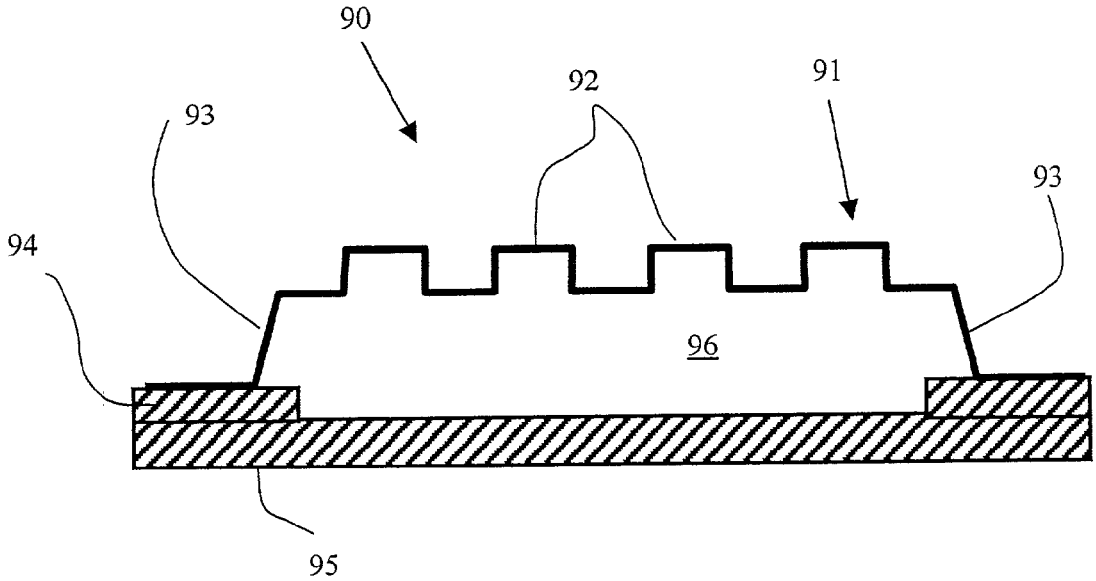
FIG. 15 is a cross-section similar to that of FIG. 4 through another embodiment of bending wave panel-form loudspeaker according to the invention.

FIG. 15 is a cross-section through a bending wave panel-form loudspeaker (90) generally of the kind shown in FIG. 4 formed with corrugations (92) and in which the thermoformed sheet forming the acoustic diaphragm (91) is provided with a marginal portion (93) forming a resilient suspension by which the diaphragm (91) is supported on a frame (94). In this case the diaphragm forms, along with a backboard (95), an enclosed cavity (96).

Figure 16:
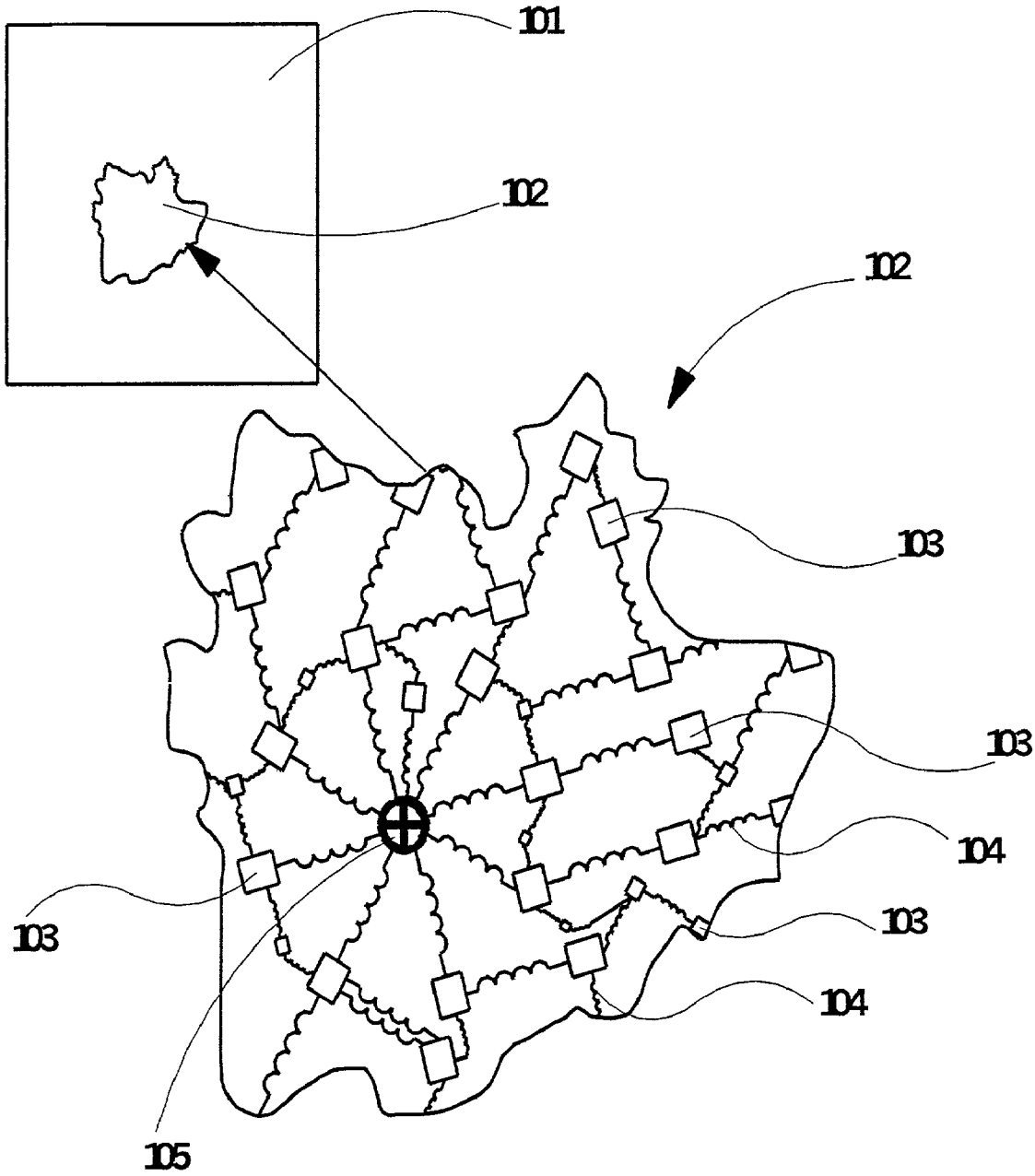
FIG. 16 is a plan view of an acoustic diaphragm according to the invention showing an engineering simulation.

FIG. 16 is a diagrammatic illustration of a sheet (101) for a bending wave panel-form acoustic radiator having one portion (102) enlarged to show how discrete areas of the sheet, e.g. macro or micro areas, can be analysed by considering the areas to be formed as a series of masses (103) connected by springs (104). A vibration exciter position is indicated by (105).

Figure 17:
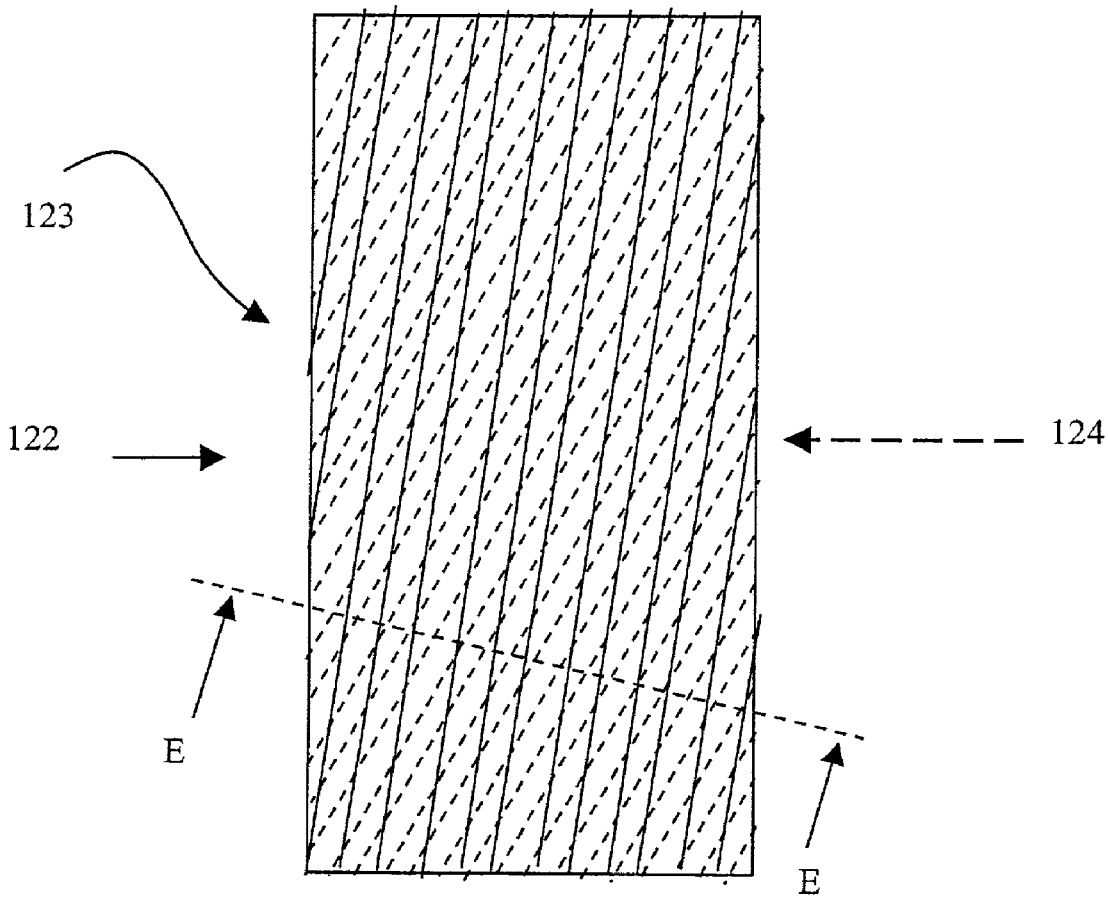
FIG. 17 is a plan view of a further embodiment of acoustic diaphragm according to the invention.
Figure 18:
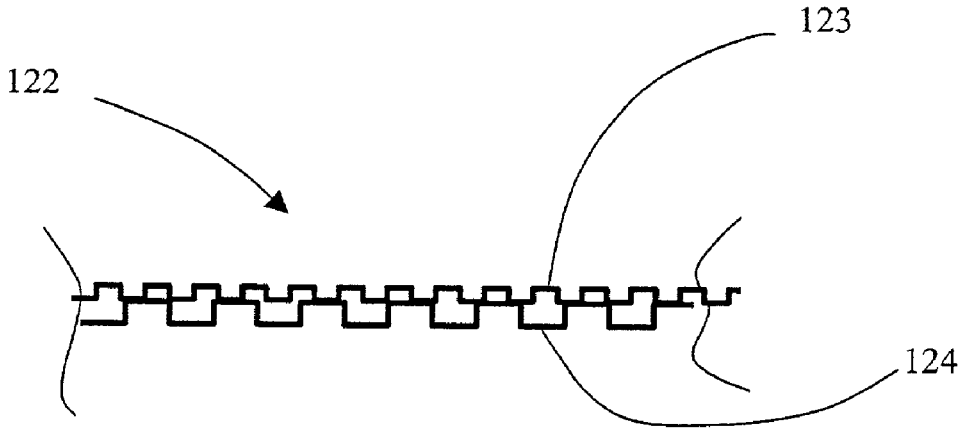
FIG. 18 is a partial cross-section on the line E—E of FIG. 17.

Referring to FIGS. 17 and 18, there is shown a panel-form bending wave acoustic diaphragm or radiator (122) for use in a loudspeaker, e.g. of the kind shown in FIG. 4, and in which the radiator consists of two overlaid thermoformed corrugated sheets (123, 124), e.g. of the kind shown in FIGS. 6 and 8 to 14, the two sheets being bonded together face to face, e.g. with the aid of an adhesive or by welding. Where the sheets are of polypropylene, the faces to be joined can be coated with a thermoplastic material of lower melting point than the polypropylene of the sheets, so that the coating can be melted to unite the two sheets without melting the sheets themselves.

As shown, the corrugations on both sheets (123,124) are rectilinear and of generally square cross-sections and extend obliquely across the sheets. The angle of the corrugations on the sheets is arranged to be different and the pitch of the corrugations is also different in the example shown.

In FIGS. 19 to 23, there is shown an embodiment of bending wave acoustic diaphragm (131) of the general kind shown in FIGS. 17 and 18, that is to say comprising a plurality of plies or layers, in the present case two generally rectangular thermoformed corrugated sheets or layers (132, 133) which are identical one with the other except that one layer (132) is corrugated along the sheet with the corrugations parallel to the sheet's long edges, whereas the other layer or sheet (133) is corrugated across the sheet with the corrugations parallel to the sheet's short edges. Thus the corrugations on the two sheets (132,133) extend at right angles as indicated by the arrows C and D in FIG. 19 which have an included angle θ which is 90°. The corrugations on both sheets are of generally square cross-section and of the same height and pitch.

Figure 22A:
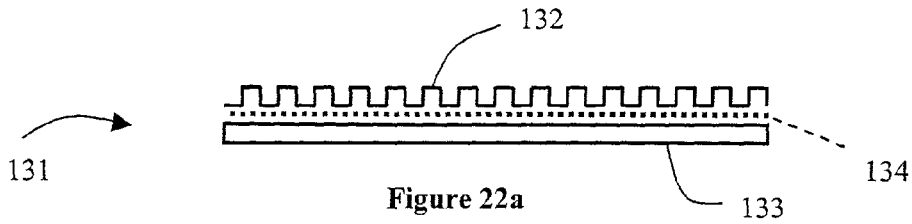
FIGS. 22*a*, 22*b* and 22*c* are side views corresponding to FIG. 21 and showing various different ways in which the layers of the diaphragm of FIG. 19 may be secured together.
Figure 22B:
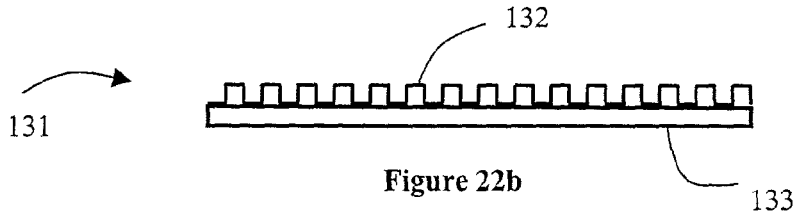
Figure 22C:
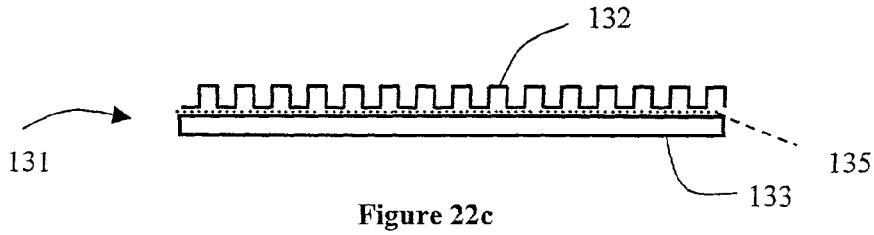

The two layers or sheets may be united, e.g. by any one of the methods illustrated in FIGS. 22*a*,*b* and *c*. In FIG. 22*a*, the sheets (132,133) are united by an interposed film of adhesive (134) which is activated by heating to fix the sheets together to form a diaphragm. In FIG. 22*b*, the sheets are joined by thermofusion. This may be achieved by coating one or both of the facing surfaces of the sheets with a thermoplastics material (not illustrated) which has a melting point lower than that of the sheets, so that on heating the layers can be melted or at least softened to cause the layers to fuse together when the sheets are brought into contact. Alternatively the sheets themselves may be softened directly, that is without any interposed coating, to a sufficient extent to cause the sheets to fuse together when brought into mutual contact. In FIG. 22*c*, one or both of the facing surfaces of the two sheets is printed with a pattern (135) of adhesive, e.g. by silk screening, so that the sheets are joined when they are brought into contact.

Figure 19:
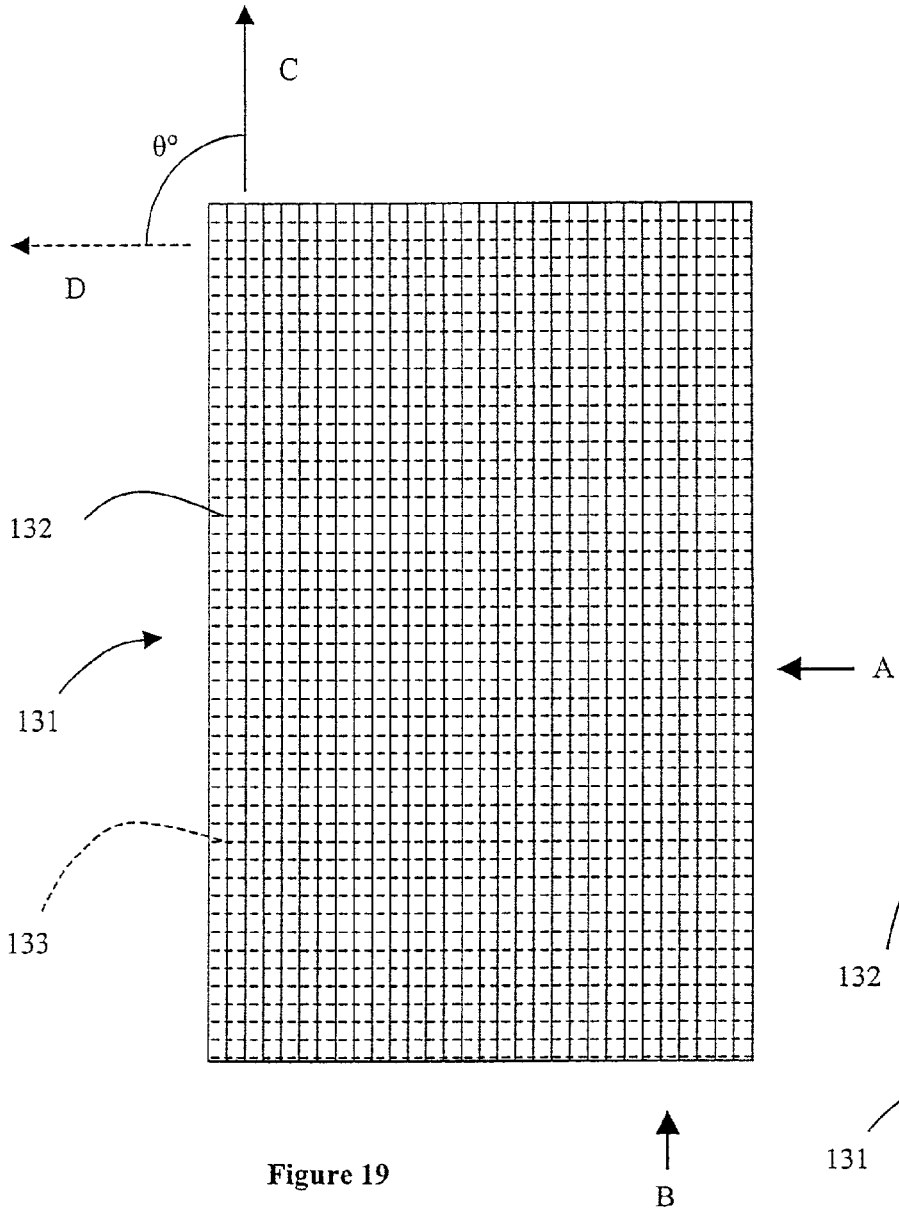
FIG. 19 is a plan view of another embodiment of acoustic diaphragm according to the invention.
Figure 20:
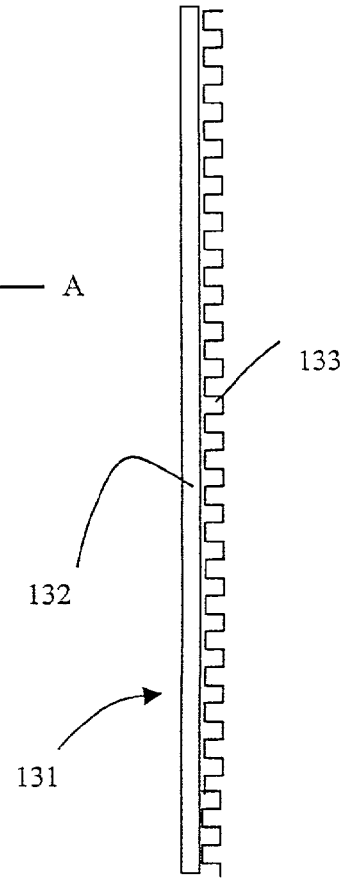
FIG. 20 is a side view of the diaphragm of FIG. 19, taken in the direction of the arrow A of FIG. 19.
Figure 21:
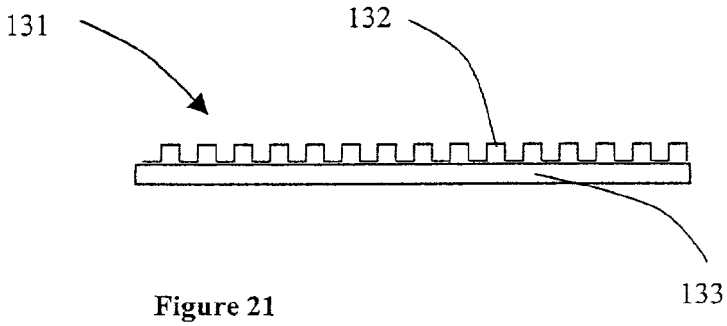
FIG. 21 is a side view of the diaphragm of FIG. 19, taken in the direction of the arrow B of FIG. 19.

As an example of the embodiment of FIG. 19, a loudspeaker was made having a panel diaphragm which had a size 190 mm by 125 mm, with each layer being made from a sheet of acrylic film of 250 μm thickness. The layers were laminated together using Sarna-Xiro Puro H hot melt adhesive which was coated on the layers at a rate of 25 gms per $m^2$ prior to vacuum forming the sheets to form the corrugated layers. The lamination conditions were 80° C. for 5 minutes under nominal pressure.

Figure 23:
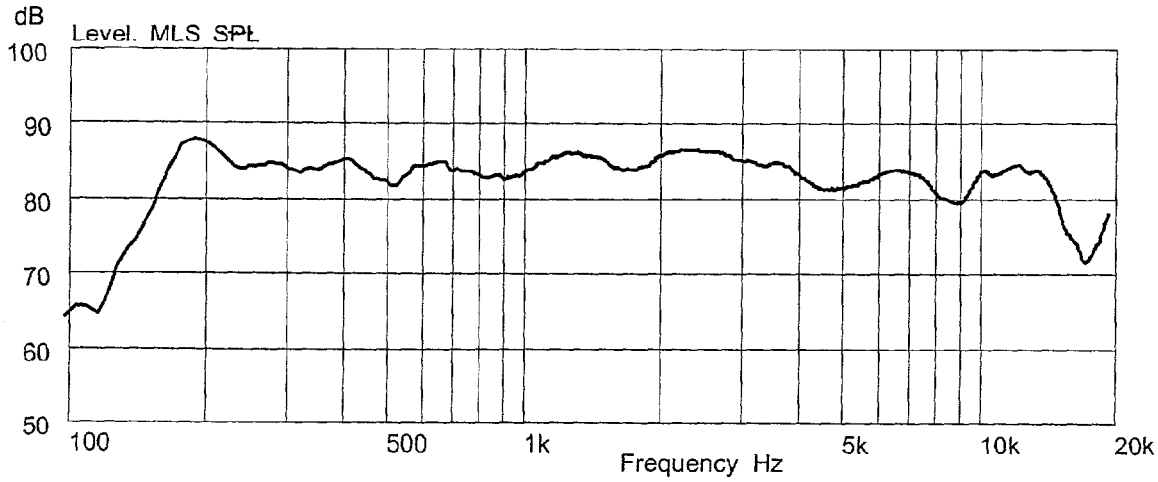
FIG. 23 is a graph of acoustic power output against frequency, of a loudspeaker employing a diaphragm as shown in FIG. 19.

The panel was fixed to a rectangular wooden picture frame having overall dimensions of 210 mm by 145 mm and an open back, via a suspension consisting of strips of 5 mm width of foam plastics (Miers M101A) extending round all the edges of the panel. A 19 mm 4 ohm Tianle inertial moving coil vibration exciter was fixed to the panel with Loctite 406 cyanoacrylate adhesive. FIG. 23 is a graph of the off-axis power response of the loudspeaker with a drive voltage of 2.83 volts at a measurement distance of 0.5 m.

The invention may be seen as a method of creating a complex modal distribution of out-of-plane resonances, which fulfil the needs of the electroacoustic specification. The final target function may involve the steps of accounting for the size of the diaphragm, the acoustic conditions, e.g. the local boundaries and the type of baffle, the desired frequency response, the possible material limitations of the sheet, plus the location and relevant properties of the method of excitation, if used.

That complex distribution may be approached by a procedure beginning with a relatively moderate number of definable elements for analysis, as few as three, and then refining and extending the analysis to increase the number of elements and thus the modal density to a satisfactory degree.

In the past when producing distributed mode loudspeakers (DML) there were two main panel options, i.e. monoliths and sandwich panels. In accordance with prior art the fundamental frequency of these panels is related to the panel stiffness, size and weight. The fundamental frequency of the panel is lowered by increasing the panel size and areal density and by reducing the panel stiffness.

The high frequency extension is determined by the panel stiffness, the core shear modulus (in the case of a sandwich panel) and the coupler ring diameter of the electromagnetic exciter. In this case the high frequency performance is extended by increasing the panel stiffness and the shear modulus of the core and by reducing the coupler ring diameter.

This requirement for low panel stiffness for good low frequency performance and a high stiffness for good high frequency extension may result in a limited bandwidth when producing small panels (i.e. smaller than A4)

As well as the corrugations increasing the high frequency performance of the panel, the corrugation profile, shape and orientation can be used to control the bending stiffness in the panel. This enables the panel properties to be tailored such that good modal performance is achieved for a wide range of panel aspect ratios. The corrugation profile may also be uniform or contain varying amplitude and/or wavelength.

The corrugated panels can be manufactured from a wide range of materials including, but not restricted to, polymers, composites, papers, metals and ceramics. These materials may be in the form of a solid monolith, foam, multilayer laminate or a combination of these. The thickness of the base material is dependent on the final panel size, but is likely to be between 100 μm and 2 mm. The corrugated panels may be formed using a variety of manufacturing processes including, but not restricted to, vacuum forming, compression moulding, injection moulding, extrusion, machining and casting.

In the cases where the manufacturing process utilises a tool which is a 'replica' of the component (e.g. vacuum forming, injection moulding, compression moulding and casting), the panel suspension can be incorporated into the panel design, e.g. as shown in FIG. 15. Since the profile, shape and form of this integral suspension control its compliance, it is possible to design the suspension such that the panel can be rigidly mounted to the housing or frame, e.g. as shown in FIGS. 1 to 4. This eliminates the need for a separate suspension and prevents resonance of the free panel edge, removing a potential source of coloration.

An alternative approach might be to form different sheet materials of different characteristics for the acoustically active area and the panel suspension respectively, the different parts being joined in any convenient matter, e.g. by adhesive means, or perhaps joined during co-forming them.

The use of a dedicated tool also enables additional features, such as jigging points, to aid assembly, drive motor and mass locator rings, to be added to the panel during the manufacturing process. These features can be used to simplify component assembly and/or enhance the aesthetics of the panel.

Thus these aesthetic features may, for example, comprise surface texture, artwork, trademarks and product identification.

When producing a corrugated panel by vacuum forming, the nature of the process imparts several restraints on the design of the panel. Of particular significance, is the thinning down of the polymer film as it conforms to the tool profile. In general, a draw ratio in excess of 75% is not recommended as this promotes excessive thinning of the film. This is particularly important in DML applications as the fatigue resistance is lowered as the film thickness is reduced.

This limit on the draw ratio has a large effect on the maximum stiffness that can be achieved and hence, the corrugated design. To double the panel stiffness, parallel to the corrugation direction (Dy), the depth and width, to maintain a draw ratio of 75%, of the corrugations need to be doubled. However, as the corrugation depth does not affect the stiffness across the corrugations (Dx), the anisotropy in the panel is also doubled.

The thinning of the polymer film during the forming process also affects the acoustic response of the panel. Mounting the exciter on the thin side of the panel leads to a reduction in high frequency output. To achieve the best high frequency performance, the exciter may be mounted on the surface that was not in contact with the tooling.

Advantages of a bending wave panel-form acoustic radiator of the present invention include:

1. Exciter region on the panel can be stiffened for better high frequency (HF) performance at no extra cost during the moulding/forming process through appropriate forming.
2. Centre of stiffness can be shifted easily, again at no extra cost whereby modality at geometrically non-optimised exciter locations can be improved.
3. Bending wave properties of the panel can be controlled by the stiffening member form and depth.
4. Since its mass/stiffness ratio can be very low, higher acoustic efficiency is achieved without effort and at no extra cost.
5. Random patterning of the stiffening members can potentially take the panel to a higher degree of randomness of vibrations in practice.
6. Due to the ability to easily manipulate the stiffness contour, a distributed mode loudspeaker (DML) of the kind described in U.S. Pat. No. 6,332,029 may be much more readily achievable in practice, that is centrally driven, dynamically-balanced drive with the ability to adjust high frequency performance and the overall tonal balance and integration with the tympanic range.
7. A conventionally accepted low distortion interface to the frame can be achieved by forming a familiar "roll surround" or similar suspension property out of the same material at no extra cost.
8. Using concentric/spiral pattern stiffening members, a tympanic radiator with controlled radiating surface area with frequency may be achieved.
9. The fact that the acoustic radiator panel is made entirely from sheet material, the tolerances in practice will only be dictated by the tolerance of that single material, which provides a considerable advantage in production.
10. By the same token the material properties such as damping of the panel can directly be controlled through the choice of the raw material and/or by a damping layer.
11. The material is not limited to synthetic plastics materials and can be pulp or egg-crate material which is very low cost and could be appropriate in certain applications. The material properties of the sheet material may be modified by suitable fillers, e.g. nano-fillers, to provide a good stiffness-to-weight ratio.

Various modifications will be apparent to those skilled in the art without departing from the scope of the invention, which is defined by the appended claims.

The invention claimed is:

1. A loudspeaker comprising a bending wave panel-form acoustic radiator and a vibration transducer coupled to the radiator, wherein the radiator is formed from material in the form of a sheet to define an acoustically active radiator area and has at least one integral stiffening member in the form of a corrugation extending out of the plane of the sheet and at least partially across the acoustically active area of the radiator so as to be exposed on at least one face of the radiator, which stiffening member is of substantially U-shaped cross section, the transducer being coupled to the acoustically active area of the radiator.

2. A loudspeaker according to claim 1, wherein the sheet is of substantially uniform thickness over the acoustically active area within the limitations imposed by the integral forming of the stiffening member(s).

3. A loudspeaker according to claim 1 or claim 2 comprising stiffening members arranged to extend in a plurality of directions across the acoustically active area.

4. A loudspeaker according to claim 3, wherein the stiffening members extend substantially wholly across the acoustically active area.

5. A loudspeaker according to claim 4, wherein the acoustically active area is substantially filled with closely spaced stiffening members.

6. A loudspeaker according to claim 5, wherein the stiffening members are rectilinear.

7. A loudspeaker according to claim 3, wherein the stiffening members are rectilinear.

8. A loudspeaker according to claim 3, wherein the stiffening members are disposed in a substantially radial array extending from a position on the acoustically active area at which a vibration exciter is intended to be located.

9. A loudspeaker according to claim 8, comprising substantially planar portions of the acoustically active area of the sheet defined between the substantially radial stiffening members.

10. A loudspeaker according to claim 1 or claim 2 comprising stiffening members arranged in a parallel array.

11. A loudspeaker according to claim 10, wherein the stiffening members extend substantially wholly across the acoustically active area.

12. A loudspeaker according to claim 11, wherein the acoustically active area is substantially filled with closely spaced stiffening members.

13. A loudspeaker according to claim 12, wherein the stiffening members are rectilinear.

14. A loudspeaker according to claim 10, wherein the stiffening members are rectilinear.

15. A loudspeaker according to claim 10, wherein the stiffening members are disposed in a substantially radial array extending from a position on the acoustically active area at which a vibration exciter is intended to be located.

16. A loudspeaker according to claim 15, comprising substantially planar portions of the acoustically active area of the sheet defined between the substantially radial stiffening members.

17. A loudspeaker according to claim 1 or claim 2, wherein the stiffening members are of substantially uniform cross-section over their lengths.

18. A loudspeaker according to claim 1 or claim 2, wherein the acoustically active area is generally rectangular and wherein the stiffening members extend at an angle to the edges of the acoustically active area.

19. A loudspeaker according to claim 1 or claim 2, wherein the stiffening members are endless.

20. A loudspeaker according to claim 1 or claim 2, wherein the stiffening members comprise portions of their length extending in different directions.

21. A loudspeaker according to claim 1 or claim 2, wherein the stiffening members are discrete.

22. A loudspeaker according to claim 21, wherein the stiffening members are shaped to be rounded in cross-section so as to avoid sharp edges.

23. A loudspeaker according to claim 1 or claim 2, wherein the sheet material is of a plastically deformable material.

24. A loudspeaker according to claim 1 or claim 2, wherein the sheet comprises a termination area at least partially surrounding the acoustically active area.

25. A loudspeaker according to claim 1 or claim 2, wherein the stiffening member is of substantially uniform height over its length.

26. A loudspeaker according to claim 1 or claim 2, wherein the acoustic radiator comprises a corrugated sheet.

27. A loudspeaker according to claim 1 or claim 2, wherein the acoustic radiator comprises a plurality of corrugated sheets.

28. A loudspeaker according to claim 27, wherein the plurality of corrugated sheets are united face to face.

29. A loudspeaker according to claim 28, wherein corrugations on one sheet are angled with respect to adjacent corrugations on an adjacent sheet.

30. A loudspeaker according to claim 1, wherein the panel is a plastics thermoforming.

31. A loudspeaker according to claim 30, wherein the vibration transducer is mounted to the side of the panel from which plastics was moved to form the stiffening member.

* * * * *